US007354232B1

(12) United States Patent
Yeaple

(10) Patent No.: US 7,354,232 B1
(45) Date of Patent: Apr. 8, 2008

(54) INDIVIDUAL BOOKBINDING DEVICE, SYSTEM, AND ASSOCIATED METHODS

(75) Inventor: Ronald N. Yeaple, Orlando, FL (US)

(73) Assignee: Yeaple Corporation, Orlando, FL (US)

( * ) Notice: Subject to any disclaimer, the term of this patent is extended or adjusted under 35 U.S.C. 154(b) by 0 days.

(21) Appl. No.: 11/833,470

(22) Filed: Aug. 3, 2007

Related U.S. Application Data

(63) Continuation of application No. 10/737,297, filed on Dec. 16, 2003, now Pat. No. 7,252,472.

(51) Int. Cl.
*B42C 9/00* (2006.01)

(52) U.S. Cl. ..... 412/8; 412/5; 412/6; 412/33; 281/21.1; 156/379.7; 156/908

(58) Field of Classification Search ..... 412/1, 412/6, 8, 32, 33, 36, 37, 4, 5; 281/15.1, 21.1; 156/273.9, 274.2, 379.7, 908
See application file for complete search history.

(56) References Cited

U.S. PATENT DOCUMENTS

| | | | |
|---|---|---|---|
| 2,579,488 | A | 12/1951 | Freeman |
| 2,607,614 | A | 8/1952 | Wiser |
| 3,717,366 | A | 2/1973 | Decker |
| 4,077,078 | A | 3/1978 | Snellman et al. |
| 4,108,713 | A | 8/1978 | Weisz |
| 4,141,100 | A | 2/1979 | Domroe et al. |
| 4,289,330 | A | 9/1981 | Wiermanski |
| 4,385,225 | A | 5/1983 | Giulie |
| 4,416,713 | A | 11/1983 | Brooks |
| 4,743,740 | A | 5/1988 | Adee |
| 4,848,797 | A | 7/1989 | Vercillo et al. |
| 4,855,573 | A | 8/1989 | Vercillo et al. |
| 4,898,506 | A | 2/1990 | Lázár |
| 5,120,176 | A | 6/1992 | Bhatia et al. |
| 5,156,510 | A | 10/1992 | Uehara |
| 5,256,859 | A | 10/1993 | Nanos et al. |
| 5,275,520 | A | 1/1994 | Yano et al. |
| 5,314,283 | A | 5/1994 | Zoltner |
| 5,340,155 | A | 8/1994 | Podosek |
| 5,454,680 | A | 10/1995 | Lázár |

(Continued)

FOREIGN PATENT DOCUMENTS

| | | |
|---|---|---|
| EP | 0 334 260 | 3/1989 |

(Continued)

*Primary Examiner*—Monica Carter
*Assistant Examiner*—Eric A. Gates
(74) *Attorney, Agent, or Firm*—Allen, Dyer, Doppelt, Milbrath & Gilchrist, P.A.

(57) ABSTRACT

A stack of pages can be bound along a binding edge to form a book by positioning a first side of an elongated conductive metal foil strip in contact with the binding edge. The strip has opposed ends, opposed side edges extending between the ends, and an adhesive with a predetermined melting temperature in contact with at least a portion of a first side thereof. The strip has been altered from a first configuration to a second configuration so as to enhance a resistance of the strip between the ends from a first value to a second value substantially greater than the first value. A voltage is applied across the strip sufficient to melt the adhesive to bind the stack of pages together along the binding edge.

21 Claims, 4 Drawing Sheets

U.S. PATENT DOCUMENTS

| | | | | |
|---|---|---|---|---|
| 5,465,213 | A | 11/1995 | Ross | |
| 5,829,938 | A | 11/1998 | Hartwig et al. | |
| 5,833,423 | A | 11/1998 | Yamaguchi et al. | |
| 6,056,493 | A * | 5/2000 | Hartwig et al. | 412/8 |
| 6,188,297 | B1 * | 2/2001 | Akiba | 333/12 |
| 6,508,881 | B1 | 1/2003 | Müller et al. | |
| 6,652,210 | B1 | 11/2003 | Yeaple | |
| 6,910,842 | B1 | 6/2005 | Yeaple | |
| 2002/0064437 | A1 | 5/2002 | Kuramoto et al. | |
| 2003/0063963 | A1 | 4/2003 | Kuramoto et al. | |

FOREIGN PATENT DOCUMENTS

| | | |
|---|---|---|
| EP | 0 334 261 | 3/1989 |
| EP | 0 481 633 | 10/1991 |
| FR | 2 546 822 | 12/1984 |

* cited by examiner

INDIVIDUAL BOOKBINDING DEVICE, SYSTEM, AND ASSOCIATED METHODS

CROSS-REFERENCE TO RELATED APPLICATION

This application is a continuation of application Ser. No. 10/737,297, filed Dec. 16, 2003, now U.S. Pat. No. 7,252,472, which itself claimed priority to provisional application Ser. No. 60/446,013, filed on Feb. 6, 2003.

BACKGROUND OF THE INVENTION

1. Field of the Invention

The present invention relates to systems and methods for binding pages together, and, more particularly, to such systems and methods for binding individual books.

2. Description of Related Art

A variety of different techniques are known for binding books. At one end of the spectrum is the so-called perfect binding technique used for paperback books. Individual page sheets are bound directly to the inside of the spine of the cardboard cover using a hot-melt adhesive that is solid at room temperature. Perfect binding is suitable for paperback books produced in large quantities. The high-volume machines used for perfect binding are very large and costly and must be set up for each run of books, a time-consuming process that often results in making trial copies that must be discarded. High-volume perfect binding machines are not practical for running single copies of books such as those downloaded from the Internet.

Thermal tape is another means for binding books and is often employed as a finishing operation for high-volume xerographic duplicators. The pages are individual sheets, usually 8½×11 inches, and the covers are cardboard sheets of the same size as the pages. Paper tape coated on one side with hot-melt adhesive forms the spine of the book, and the adhesive is activated as it passes over heated surfaces inside the machine. There is no way to print the title and author's name on the spine unless pasted on in a separate label. While thermal tape is a convenient method for binding small lots of booklets such as college course packs, such booklets do not offer the aesthetic appeal of high-quality bound volumes.

There are various other means for binding small quantities of books using staples, plastic combs, wire spirals, and plastic posts, none of which provides the look and feel of a fine bound volume.

A preferred method for binding books is the traditional cloth binding technique used for hardcover books. The pages are printed on large sheets called signatures, which are then folded, sewed and glued together, and then trimmed. The cover consists of front and back cardboard pieces encased in decorative cloth binding material, which also forms the hinges and outer spine. Cloth binding has advantages of quality appearance, durability, and ease of page turning, since the pages are glued to a flexible inner cloth spine that is fastened to the outer spine only at its edges. Like perfect binding, cloth binding is a high-volume process involving the use of large and costly machines, and is therefore not suitable for binding single copies. There are a few craftsmen who specialize in custom binding or repairing single cloth bound books, but such work is highly skilled and expensive.

At the high end of the spectrum are leather-bound books. Produced by a process similar to cloth binding, leather-bound books offer the ultimate in luxurious appearance.

It is known in the art to heat a hot-melt adhesive onto page edges to bind a book with an external heater. It is also known to heat a hot-melt adhesive coated on an electrically resistive layer applied to the inner surface of a report binder with the use of a power supply. It is also known to use a microwave-activatable adhesive to bind books, with the adhesive placed between a sheaf of papers and the binder. Additionally, it is known to employ individual book-binding apparatus following the printing of a book from a storage medium such as a database.

Although there is widespread interest in methods for binding cut sheets from desktop computer printers into high-quality books, no commercially viable, easy-to-use device has been disclosed.

SUMMARY OF THE INVENTION

The present invention provides a system and method for binding an individual book having superior aesthetic qualities, that can create a book with a plurality of cover types, including both hard covers and soft covers, and is easily adaptable to books of various sizes. Books made by the present system and method do not require trimming of the book or the binding strip upon completion of the binding process.

The present invention is directed to a system and method for binding a stack of pages along a first edge thereof to form a book. The system comprises an elongated resistive strip having an adhesive in contact with at least a portion of a first side, the adhesive having a melting temperature. The strip has two opposed ends and an electrical resistivity extending between the ends. The strip is dimensioned to substantially cover the first edge of the stack, with the first side against the first edge of the stack. Preferably the strip has a series of alternating finely scribed, spaced-apart cuts extending therethrough. In a preferred embodiment the strip comprises a foil.

The system additionally comprises means for introducing an electrical current to pass along the strip between the ends. The current should be sufficient to create enough heat in the strip to achieve a temperature at least as great as the melting temperature. The melted adhesive then serves to bind the stack of pages together along the stack's first edge.

The features that characterize the invention, both as to organization and method of operation, together with further objects and advantages thereof, will be better understood from the following description used in conjunction with the accompanying drawings. It is to be expressly understood that the drawings are for the purpose of illustration and description and are not intended as a definition of the limits of the invention. These and other objects attained, and advantages offered, by the present invention will become more fully apparent as the description that now follows is read in conjunction with the accompanying drawings.

DETAILED DESCRIPTION OF THE PREFERRED EMBODIMENTS

A description of the preferred embodiments of the present invention will now be presented with reference to FIGS. 1A-5B.

In the present invention, the term "book" may comprise any collection of individual sheets that are desired to be bound together, and should not be taken as a limitation. Preferably all the pages should be of substantially the same size.

The invention is contemplated for use in such applications as binding a stack of pages that have been printed from another source, such a desktop computer printer, as a download from a remote location (e.g., a site on the Internet), or a storage medium such as a disk. However, this application is not intended as a limitation, and one of skill in the art will understand that the invention may be used in any binding situation.

The present invention is generally directed to the binding of books wherein electric current is used to melt adhesive positioned adjacent the page stack edge desired to be bound in a hot-melt binder. The hot-melt adhesive is supplied in solid form, precoated on an electrically resistive strip. In use, the width of the adhesive strip can first be trimmed to the approximate thickness of the page stack of the book, such as by using ordinary office shears or a paper cutter. Similarly, the length of the strip can be trimmed to the approximate length of the page stack. Alternatively, various precut widths and lengths of strips may be supplied to a consumer.

Figure 1A:
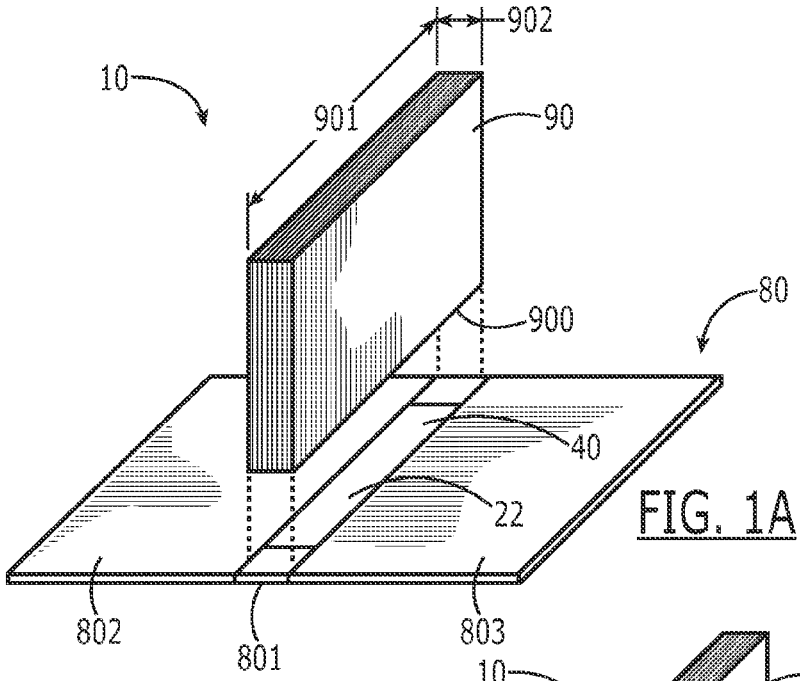
FIGS. 1A-1D illustrate the system and method of the present invention for binding an individual book.
Figure 1B:
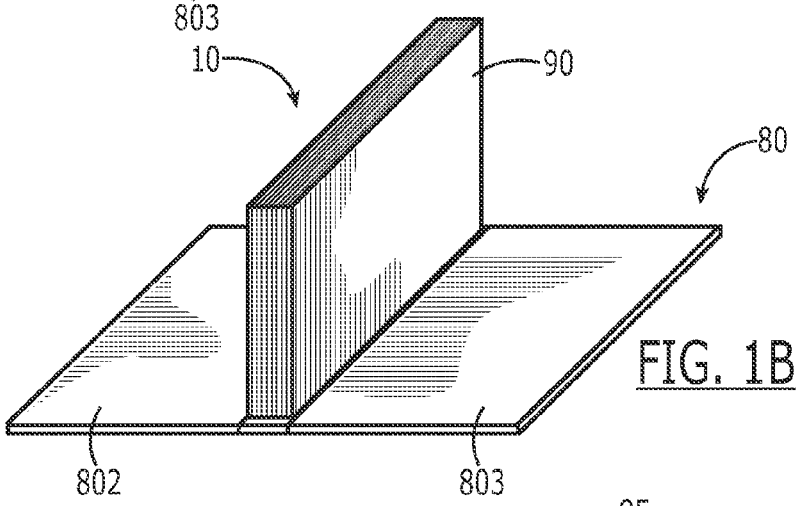
Figure 1C:
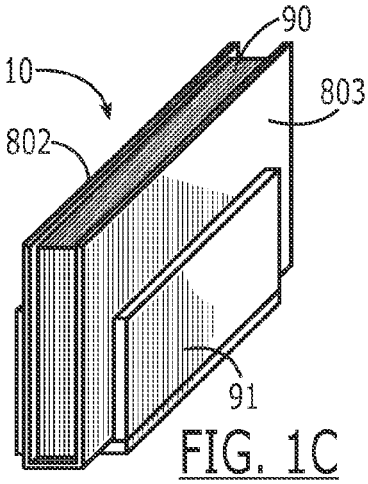

In the embodiment of the system 10 and method of the invention shown in FIGS. 1A-1D, the resistive strip 22 is shown as being supplied precut to match the standard lengths of various books. The resistive strip 22 is placed on the spine area 801 of the cover sheet (FIG. 1A) and the page stack 90 is positioned so as to rest on the resistive strip 22 (FIG. 1B). The front 802 and back 803 of the cover 80 are folded upward along the sides of the page stack 90, and the assemblage 95 is placed into an adjustable-width squared-U-shaped holder 91 (FIG. 1C) to maintain the position of the parts during the binding process.

Figure 1D:
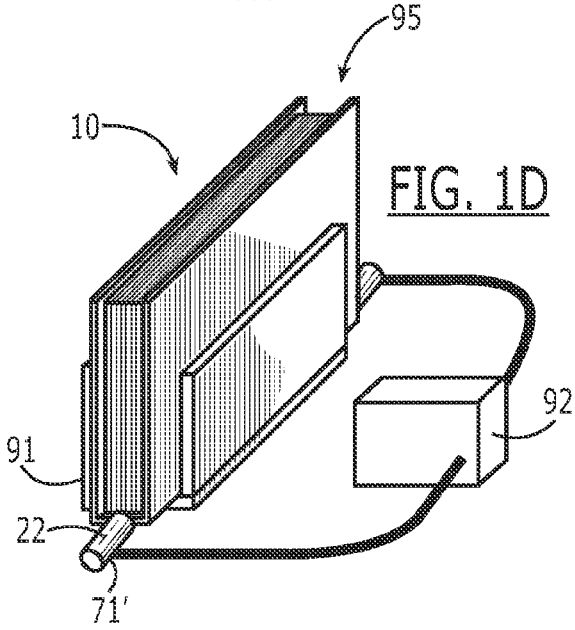

Next electrical clip leads 71' are attached to the contacts of the resistive strip 22 (FIG. 1D). A source of electrical current 92 in contact with the leads 71' is activated, so that the flow of current for a predetermined time heats the resistive strip 22, causing the adhesive 40 to melt. At the conclusion of the heating cycle, the clip leads 71' are pulled out, and the page stack 90 is pressed downward toward the spine 801 to fill any spaces previously occupied by the clip leads 71'. The assembled book is then left in the holder 91 for several minutes while the adhesive completely solidifies.

Four exemplary embodiments of the adhesive-coated flexible elongated strip of the present invention are illustrated in FIGS. 2A-5B. In all the cases contemplated in the preferred embodiments, the strip has an electrical resistivity and is coated or impregnated on at least a portion of a first side with a solidified hot-melt adhesive. Sufficient electrical current is passed through the strip to generate sufficient heat in the strip to melt the adhesive.

The resistive strip may comprise any of a number of materials known in the art, preferably a flexible material in order to impart flexibility to the binding. The material may be selected from a group consisting of metal foil or mesh; conductive inks, foils, paints, or layers printed, coated, or vacuum deposited on a paper, cloth, plastic, or another substrate; or from woven or nonwoven carbon-fiber material. These materials are not intended to be limiting on the invention.

Figure 2A:
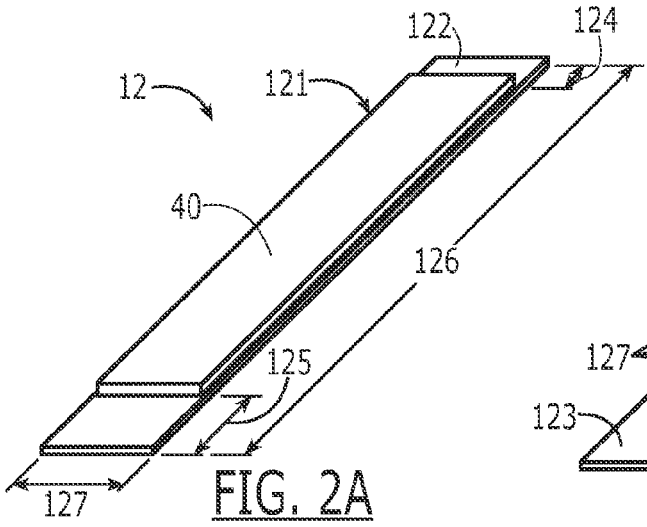
FIGS. 2A and 2B are top and bottom perspective views of a first embodiment of the foil strip.
Figure 2B:
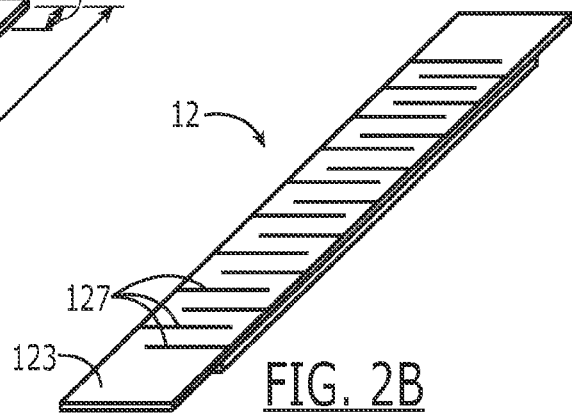
Figure 3A:
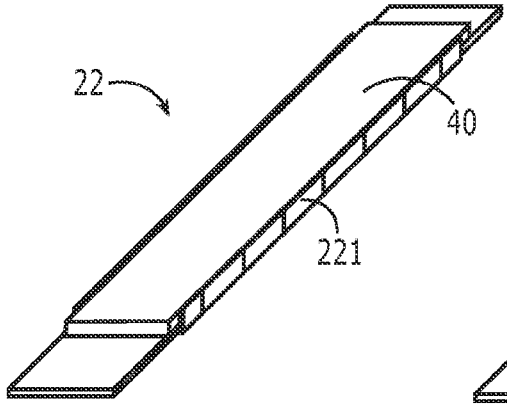
FIGS. 3A and 3B are top and bottom perspective views of a second embodiment of the foil strip.
Figure 3B:
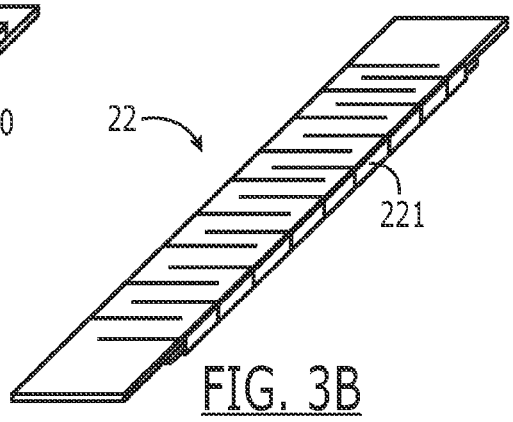

A best mode of this invention, as believed at the date of filing this application, comprises the use of a sheet of metal foil for the resistive strip, although it will be understood by one of skill in the art that other materials such as those described above might also serve. Experiments have shown that materials such as aluminum foil and brass foil are suitable, provided such strips are fabricated with alternating finely scribed cuts as shown in FIG. 2B to raise their electrical resistance.

As an exemplary embodiment, a strip of aluminum foil 0.625 in. wide, 6 in. long, and 0.0005 in. thick has been found to have a resistance of about 0.05 ohms before the alternating scribed cuts are made. This is too low a resistance to provide a practical impedance match to a power supply and would act instead as a short circuit. One alternative to raise the resistance of the strip would be to use a thinner foil, but this would make the foil very fragile. A more practical solution is the addition of alternating finely scribed cuts approximately 0.005 in. wide extending through the foil and spaced approximately 0.125 in. apart, which have been found to raise the resistance by a factor of ten times, to about 0.5 ohms in the example cited. Applying low voltages in the 3-5 volt range generates the power levels necessary to melt the adhesive for what is believed to be a typical book in less than one minute, typically 25 watts. In a preferred embodiment, the cuts extend inwardly from and generally perpendicular to the sides of the strip, with cuts extending from a first side alternating with cuts extending from a second side of the strip, the inner sections of the cuts overlapping along a central portion of the strip.

A first embodiment of the strip 12 of the present invention (FIGS. 2A,2B) comprises a central portion 121 that is coated on a first side 122 with a hot-melt adhesive 40. In use, as discussed above with reference to FIGS. 1A-1D, the first side 122 is placed against the first edge 900 of the page stack 90; the second side 123 is placed against the inside of the spine 801 of the cover 80.

The two opposed end portions 124,125 surrounding the central portion 121 are substantially uncoated. The length 126 of the strip 12 is dimensioned to be approximately the length 901 of the page stack 90 desired to be bound; the width 127 of the strip 12 is dimensioned to be approximately the width 902 of the page stack 90. Alternating cuts 127 are scribed through the foil partway across the width of the strip 12, as shown in FIG. 2B. These cuts 127 greatly decrease the effective cross-sectional area of the conductor and greatly increase its effective length, thereby substantially raising its electrical resistance. As an example, experiments have shown that if the cuts 127 are scribed alternatively about 0.125 in. apart, so that the effective width of the conductor is about 0.125 in., the resistance of the strip is raised by about 10 times compared to the resistance of the same strip before scribing. The resistance can be raised by an even larger factor by scribing the cuts 127 closer together.

An unanticipated advantage of the scribed cuts 127 was found through experimentation. During the heating cycle, a limited amount of melted adhesive 40 flows through the cuts 127 to simultaneously bind the cover 80 to the page stack 90, thus eliminating the need for precoating a separate layer of adhesive on the bottom surface 123 of the foil 12.

A second embodiment of the strip 22 of the present invention (FIGS. 3A,3B) adds upturned side edges 221 of the foil to support a thicker adhesive layer 40, should this be desirable for securely binding certain page stacks 90 such as those where the pages have irregular edges.

A third embodiment of the strip 32 of the present invention (FIGS. 4A,4B) permits a strip of standard length to be cut by the user to fit a smaller book. In the depicted embodiment a central sector 321 is coated on a first side 322 with a hot-melt adhesive 40, leaving two short gaps 323 and 324 in the coating. Here two end sectors 329, terminating in spaced relation from the strip's ends 326, are also coated with adhesive 40. The gaps 323,324 facilitate the strip's 32 being able to be cut into shorter lengths for books having shorter spine lengths. The uncoated gaps 323,324 serve as contacts for the shorter lengths if the strip 32 is cut to length in this manner. Since the gaps 323,324 in the adhesive coating are short relative to the overall length 325 of an uncut strip 32, there is no significant loss of binding strength for an uncut strip. One of skill in the art will recognize that more or fewer sectors and gaps may be contemplated, for example, two end sectors with one gap therebetween.

As an exemplary embodiment, if the uncut strip is 11 in. long, two gaps 323,324 in the adhesive coating each 1 in. long centered at 2 in. and 7 in., respectively, from one end 326 will permit the user to cut the strip 32 with ordinary office shears to bind books having spine lengths of 2, 4, 5, 7, or 9 in., as well as 11 in. for the uncut strip. The advantage is that this greatly reduces the need for large inventories of strips to bind books of various sizes.

Figure 4A:
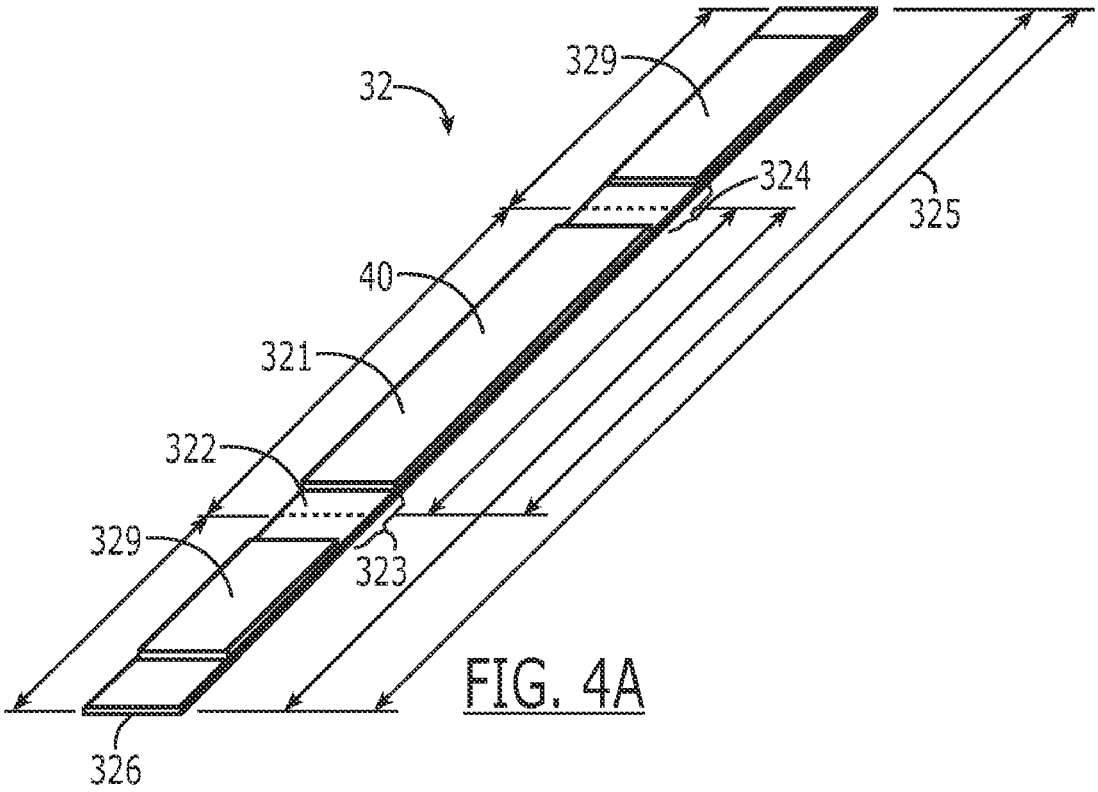
FIGS. 4A and 4B are top and bottom perspective views of a third embodiment of the foil strip.
Figure 4B:
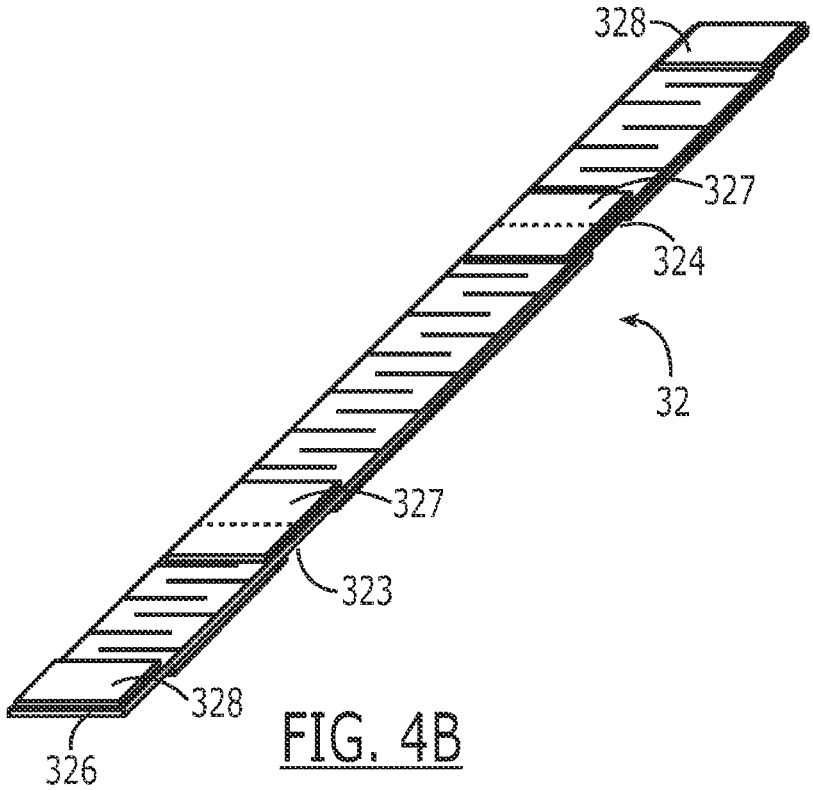

Short pieces of double-sided pressure-sensitive tape 327 are applied to the bottom surface of the strip under gaps 323 and 324 for mechanical reinforcement of the uncoated foil areas during handling, as shown in FIG. 4B. These pieces of pressure-sensitive tape 327 also serve to tack the strip 32 to the inside cover spine 801 during assembly of the book prior to the binding cycle. Additional pieces of double-sided pressure-sensitive tape 328 are also added at the ends to provide further support during assembly.

Figure 5A:
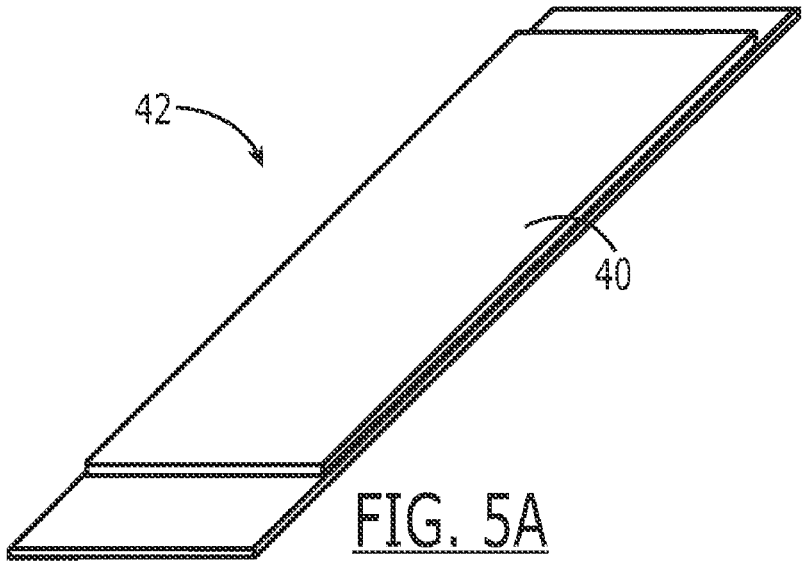
FIGS. 5A and 5B are top and bottom perspective views of a fourth embodiment of the foil strip.
Figure 5B:
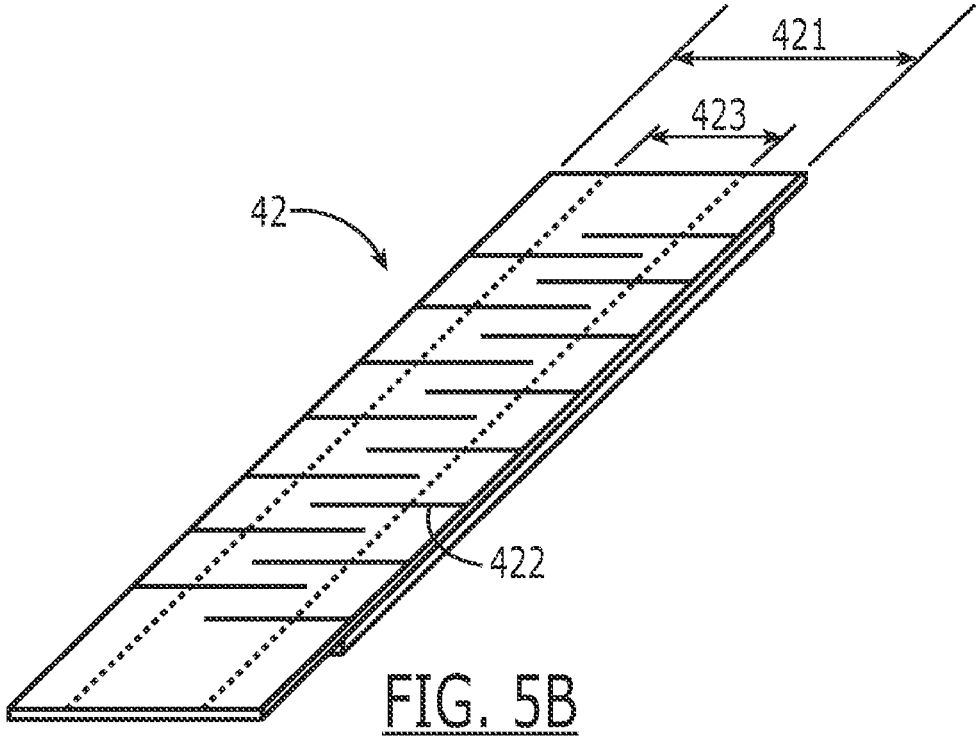

A fourth embodiment of the strip 42 of the present invention (FIGS. 5A,5B) permits a strip of standard width 421 to be cut by the user to fit a narrower book. The scribed cuts 422 extend only partway across the width of the strip 42 (FIG. 5B). The user can trim the width of the strip 42 with ordinary office shears up to the dashed lines 423 marked on the bottom of the strip 42 without severing the electrical continuity of the strip 42.

As exemplary embodiments, strips available in standard untrimmed widths of 0.5, 0.75, 1, 1.5, and 2 in. could be trimmed to fit a continuous range of book thicknesses from 0.25 to 2 in. Again, the advantage is a greatly reduced inventory of strips needed to accommodate books of various thicknesses.

An unexpected advantage was uncovered during testing of this embodiment. For an untrimmed strip, most of the heat is generated during the binding cycle in the central part of the strip, between the dashed lines shown in FIG. 5B. However, laboratory experiments have shown that the melted adhesive in the central part rapidly transfers heat to the adhesive along the edges, which quickly melts, thus making this a practical design.

It is recognized that all these embodiments can be simultaneously incorporated into a single strip design if appropriate for such reasons as to minimize inventories.

Although much of the exposition of the present invention has been presented in terms of binding paperback books, it is obvious that the same system and method apply equally well to the binding of cloth- and leather-bound books.

In the foregoing description, certain terms have been used for brevity, clarity, and understanding, but no unnecessary limitations are to be implied therefrom beyond the requirements of the prior art, because such words are used for description purposes herein and are intended to be broadly construed. Moreover, the embodiments of the apparatus illustrated and described herein are by way of example, and the scope of the invention is not limited to the exact details of construction.

What is claimed is:

1. A system for binding a stack of pages along an edge thereof to form a book, the system comprising an elongated conductive metal foil strip having opposed ends and opposed side edges extending between the ends, the strip having been altered from a first configuration to a second configuration so as to enhance a resistance of the strip between the ends from a first value to a second value substantially greater than the first value, the strip further having an adhesive with a predetermined melting temperature in contact with at least a portion of a first side thereof, a portion of the strip adjacent each of the side edges uncoated with adhesive, the side edge portions foldable upward to surround the adhesive, the strip first side positionable in contact with a binding edge of a stack of pages to be bound, the strip further having end portions adjacent the ends, the end portions adapted for introducing an electrical current thereto to pass along the strip between the ends, the current sufficient to heat the strip to a temperature at least as great as the melting temperature in order to melt the adhesive and thereby bind the stack of pages together along the binding edge.

2. The system recited in claim 1, further comprising a power supply connectable to the strip end portions, the strip end portions substantially uncoated with adhesive, and wherein the strip in the first configuration has an impedance that does not match an impedance of the power supply, and the strip in the second configuration has an impedance match with the power supply.

3. The system recited in claim 2, further comprising a pair of conductive metal contacts affixable at a first end to the strip end portions and at a second end to the power supply.

4. The system recited in claim 2, wherein the power supply is adapted to provide a voltage in a range of 3-5 volts, the voltage range sufficient to heat at least a portion of the strip to the adhesive melting temperature.

5. The system recited in claim 1, wherein the adhesive is positioned in at least two sectors comprising two end sectors having a gap therebetween, the gap having a length substantially less than a length of the end sectors, the gap providing a location for excision if shortening of the strip is desired.

6. The system recited in claim 1, wherein the strip further comprises a double-sided pressure-sensitive tape adhered to a second side of the strip opposed to the first side, the tape positioned beneath each gap for providing mechanical reinforcement and further providing means for affixing the strip to an inside of a cover spine.

7. The system recited in claim 1, wherein the first resistance value comprises approximately 0.05 ohms and the second resistance value comprises approximately 0.5 ohms.

8. The system recited in claim 1, wherein the strip is longitudinally excisable if desired up to a predetermined distance from the side edges, an excision operable substantially not to alter the strip resistance.

9. The system recited in claim 1, wherein the adhesive comprises a hot-melt adhesive applicable to the strip in solid form.

10. The system recited in claim 1, further comprising a generally squared-"U"-shaped holder having a gap between two arms thereof, the gap having a width sufficient to admit the page stack and a cover.

11. A method for binding a stack of pages along an edge thereof to form a book, the method comprising the steps of:

positioning a first side of an elongated conductive metal foil strip in contact with a binding edge of a stack of pages desired to be bound, the strip having opposed ends, opposed side edges extending between the ends, and an adhesive with a predetermined melting temperature in contact with at least a portion of a first side thereof, the strip having been altered from a first configuration to a second configuration so as to enhance a resistance of the strip between the ends from a first value to a second value substantially greater than the first value; and applying a voltage across the strip sufficient to melt the adhesive to bind the stack of pages together along the binding edge.

12. The method recited in claim 11, wherein the melting step comprises introducing an electrical current along the strip between the ends, the current sufficient to heat the strip to a temperature at least as great as the melting temperature.

13. The method recited in claim 11, further comprising the step, prior to the voltage-applying step, of folding a portion of the strip adjacent each of the side edges upward to surround the adhesive, the folded portions substantially without adhesive in contact therewith.

14. The method recited in claim 11, further comprising the steps, prior to the voltage-applying step, of:

adhering a double-sided pressure-sensitive tape to a second side of the strip opposed to the first side, and affixing the strip second side to an inside of a cover spine.

15. A book-binding element comprising an elongated conductive metal foil strip having: opposed ends and opposed side edges extending between the ends, the strip having been altered from a first configuration to a second configuration so as to enhance a resistance of the strip between the ends from a first value to a second value substantially greater than the first value, the strip further having an adhesive with a predetermined melting temperature in contact with at least a central portion of a first side thereof in spaced relation from the ends, a portion of the strip adjacent each of the side edges uncoated with adhesive, the side portions foldable upward to surround the adhesive, the strip further having opposed end portions on either side of the central portion, the end portions substantially uncoated with adhesive, the strip first side positionable in contact with a binding edge of a stack of pages to be bound, the strip in the second configuration impedance-matched with a power supply for delivering current along the strip between the end portions sufficient to heat the strip to a temperature at least as great as the melting temperature in order to melt the adhesive and thereby bind the stack of pages together along the binding edge.

16. A method of making a book-binding element comprising the steps of:

altering an elongated conductive metal foil strip from a first configuration to a second configuration so as to enhance a resistance of the strip between opposed ends from a first value to a second value substantially greater than the first value; and applying an adhesive with a predetermined melting temperature to at least a portion of a first side of the strip, the strip first side positionable in contact with a binding edge of a stack of pages to be bound, the strip in the second configuration impedance-matched with a power supply for delivering current along the strip between the ends sufficient to heat the strip to a temperature at least as great as the melting temperature in order to melt the adhesive and thereby bind the stack of pages together along the binding edge.

17. The method recited in claim 16, wherein the adhesive-applying step comprises applying the adhesive to a central portion in spaced relation from the ends, opposed end portions on either side of the central portion substantially uncoated with adhesive.

18. The method recited in claim 16, wherein the adhesive-applying step comprises avoiding applying the adhesive a portion of the strip adjacent each of the side edges, the side edge portions foldable upward to surround the adhesive.

19. The method recited in claim 16, wherein the first resistance value comprises approximately 0.05 ohms and the second resistance value comprises approximately 0.5 ohms.

20. The method recited in claim 16, further comprising the step of excising the longitudinally up to a predetermined distance from the side edges, an excision operable substantially not to alter the strip resistance.

21. The method recited in claim 16, wherein the applying step comprises applying a hot-melt adhesive to the strip in solid form.

* * * * *